US005433086A

United States Patent [19]

Cho et al.

[11] Patent Number: 5,433,086

[45] Date of Patent: Jul. 18, 1995

[54] REFRIGERATOR HAVING INDEPENDENT TEMPERATURE CONTROL OF PLURAL COMPARTMENTS

[75] Inventors: Kwang-Yeon Cho, Seoul; Kee-Tae Lee, Pucheon-Si; Yi-Wook Choi, Incheon, all of Rep. of Korea

[73] Assignee: Daewoo Electronics Co., Ltd., Seoul, Rep. of Korea

[21] Appl. No.: 133,668

[22] Filed: Oct. 7, 1993

[30] Foreign Application Priority Data

Oct. 9, 1992 [KR] Rep. of Korea ..... 1992-18605

[51] Int. Cl.[6] ..... F25D 17/00

[52] U.S. Cl. ..... 62/455; 162/275

[58] Field of Search ..... 62/455, 454, 441, 186, 62/275, 407, 408

[56] References Cited

U.S. PATENT DOCUMENTS

| | | | |
|---|---|---|---|
| 2,812,642 | 11/1957 | Jacobs | 62/186 |
| 2,866,323 | 12/1958 | Candor | 62/275 |
| 3,004,401 | 10/1961 | Mann et al. | 62/275 |
| 3,126,716 | 3/1964 | De Witte | 62/275 |
| 3,359,751 | 12/1967 | Stevens | 62/186 |
| 3,394,557 | 7/1968 | Kronenberger et al. | 62/186 |
| 4,938,034 | 7/1990 | Rosanio et al. | 62/256 |
| 5,048,306 | 9/1991 | Wakatsuki | 62/419 |
| 5,056,328 | 10/1991 | Jaster | 62/180 |

FOREIGN PATENT DOCUMENTS

| | | |
|---|---|---|
| 92203374.1 | 4/1992 | European Pat. Off. . |
| 62-50486 | 3/1987 | Japan . |

*Primary Examiner*—Henry A. Bennet
*Assistant Examiner*—William C. Doerrler
*Attorney, Agent, or Firm*—William F. Pinsak

[57] ABSTRACT

Disclosed herein is temperature regulating device for an air-circulated refrigerator capable of independently controlling the temperature of the freezer and the fresh food compartments air communicating with each other, by employing an evaporator, a first and a second fans which are all installed in the freezer compartment, and a thermostatic control circuitry.

5 Claims, 5 Drawing Sheets

REFRIGERATOR HAVING INDEPENDENT TEMPERATURE CONTROL OF PLURAL COMPARTMENTS

FIELD OF THE INVENTION

The present invention relates to an air-circulated refrigerator; and, more particularly, to an air-circulated refrigerator capable of independently controlling the temperature of each of the compartments therein by employing a novel temperature regulating mechanism.

DESCRIPTION OF THE PRIOR ART

A conventional air-circulated refrigerator employs a temperature regulating device including an evaporator and a fan which are installed in a freezer compartment, and a damper flap actuator mounted in a fresh food compartment. The freezer compartment is air communicated with the fresh food compartment through first and second passageways. A flow of air cooled by the evaporator is directly blown into the freezer compartment by the fan; and another stream of the cooled air is transferred to the fresh food compartment through the second passageway when the damper flap actuator is operated in response to a signal from a thermo-sensitive device in the fresh food compartment to open the second passageway. The air which has been circulated in the fresh food compartment is sent back to the evaporator through the first passageway and the air blown into the freezer compartment is also circulated through the first passageway back to the evaporator.

However, in the temperature regulating device described above, the temperature in the fresh food compartment is not properly regulated or is affected by the temperature in the freezer compartment since the evaporator, which cools the circulated air, is operated in response to a signal from a control device in the freezer compartment and not in response to a signal from the thermo-sensitive device in the fresh food compartment. Further, the air circulation in the fresh food compartment accomplished by a convection current tends to reduce the cooling efficiency of the fresh food compartment.

U.S. Pat. No. 5,056,328 issued to Heinz Jaster et al discloses another type of temperature regulating device comprising a first evaporator and a first fan situated in a freezer compartment, a second evaporator and a second fan situated in a fresh food compartment. These compartments also define a first and a second passageways for allowing air circulation therebetween. Each of the fans and evaporators is independently controlled in response to a signal from a thermo-sensitive device from each of the compartments, thereby maintaining desired temperatures in the freezer and the fresh food compartments. However, since the device employs dual evaporator/fan systems, the manufacturing process thereof is handicapped by various disadvantages including higher space requirements and manufacturing costs; and the power consumption thereof may also be higher.

Japanese Utility Model Application No. Sho 60-143555 discloses another temperature regulating device comprising an evaporator situated in a freezer compartment, a first fan located in the freezer compartment for supplying a stream of cold air thereinto, a damper flap actuator for permitting an air flow from the evaporator to the fresh food compartment, and a second fan located in the fresh food compartment for circulating cold air supplied thereinto. A portion of air cooled by the evaporator is directly blown into the freezer compartment by the first fan, and another portion of the cooled air is supplied to the fresh food compartment through a second passageway by opening a damper flap to make the second fan forcedly circulate the air which has been supplied into the fresh food compartment. While this device employing an evaporator and a dual fan system is capable of independently controlling the temperature in each of the compartments, the movement of air in the second passageway accomplished by a convection current causes a delay in the temperature control due to the response time, thereby decreasing the operational reliability. In addition, the damper flap actuator and the second fan located in the fresh food compartment occupy a relatively large area, further restricting the useable room in their vicinity.

SUMMARY OF THE INVENTION

Accordingly, it is an object of the present invention to provide an air-circulated refrigerator which employs a temperature regulating device capable of independently controlling the temperature of each of the freezer and the fresh food compartments therein by utilizing an evaporator and a dual fan system, all of which are installed in the freezer compartment.

It is another object of the present invention to provide an air-circulated refrigerator which employs a temperature regulating device capable of providing a larger available space in the fresh food compartment due to the substitution of a flexible flap for the damper flap actuator and relocation of the second fan into the freezer compartment.

It is a further object of the present invention to provide an air-circulated refrigerator which employs a temperature regulating device capable of performing the task of defrosting by means of an air stream warmed in the fresh food compartment and a defrosting heater installed in a first passageway when frost is formed beyond a predetermined thickness on the evaporator.

It is still another object of the present invention to provide an air-circulated refrigerator which employs a temperature regulating device capable of preventing the cold air in the freezer compartment from flowing backward into the fresh food compartment by means of a flexible flap when the second fan is stopped.

In one aspect of the present invention, there is provided an air-circulated refrigerator, incorporating therein a temperature regulating device, which includes a housing having a first and a second front doors, a pair of sidewalls, a rear wall, and a partition, a freezer compartment defined above the partition, a fresh food compartment defined below the partition and communicating, by means of air, with the freezer compartment through a first passageway formed in the partition and a second passageway formed in the rear wall, said temperature regulating device comprising: an evaporator situated in the freezer compartment for cooling air by way of evaporating a refrigerant compressed by a compressor; a first fan situated in the freezer compartment for directly supplying a flow of the air cooled by the evaporator into the freezer compartment; a second fan situated in the freezer compartment for transporting another flow of the cooled air into the fresh food compartment through the second passageway; and a first flexible flap fixed to the first passageway at its one end for permitting the air in the fresh food compartment to move to the evaporator therethrough and preventing the air in the freezer compartment from flowing into the fresh food compartment.

In another aspect of the present invention, there is provided an air-circulated refrigerator, incorporating therein a temperature regulating device, which includes a housing having a first and a second front doors, a pair of sidewalls, a rear wall, and a partition, a freezer compartment defined above the partition, a fresh food compartment defined below the partition and communicating, by means of air, with the freezer compartment through a first passageway formed in the partition and a second passageway formed in the rear wall, said temperature regulating device comprising: an evaporator situated in the freezer compartment for cooling air by way of evaporating a refrigerant compressed by a compressor; a first fan situated in the freezer compartment for directly transporting a flow of the air cooled by the evaporator into the freezer compartment; a second fan also situated in the freezer compartment for transporting another flow of the cooled air into the fresh food compartment through the second passageway; a first flexible flap fixed to the first passageway at its one end for permitting the air in the fresh food compartment to move to the evaporator therethrough and preventing the air in the freezer compartment from flowing into the fresh food compartment; at least one heater located in the first passageway for removing frost formed on the evaporator; a first thermo-sensitive device located in the freezer compartment; a second thermo-sensitive device located in the fresh food compartment in the vicinity of the second passageway; a third thermo-sensitive device located in the fresh food compartment in the vicinity of the first passageway; a frost detecting sensor located on the evaporator; and, means for controlling the operation of the first and the second fans, the heater and the compressor in response to signals from the respective thermo-sensitive devices and the sensor.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF THE PREFERRED EMBODIMENTS

Figure 1:
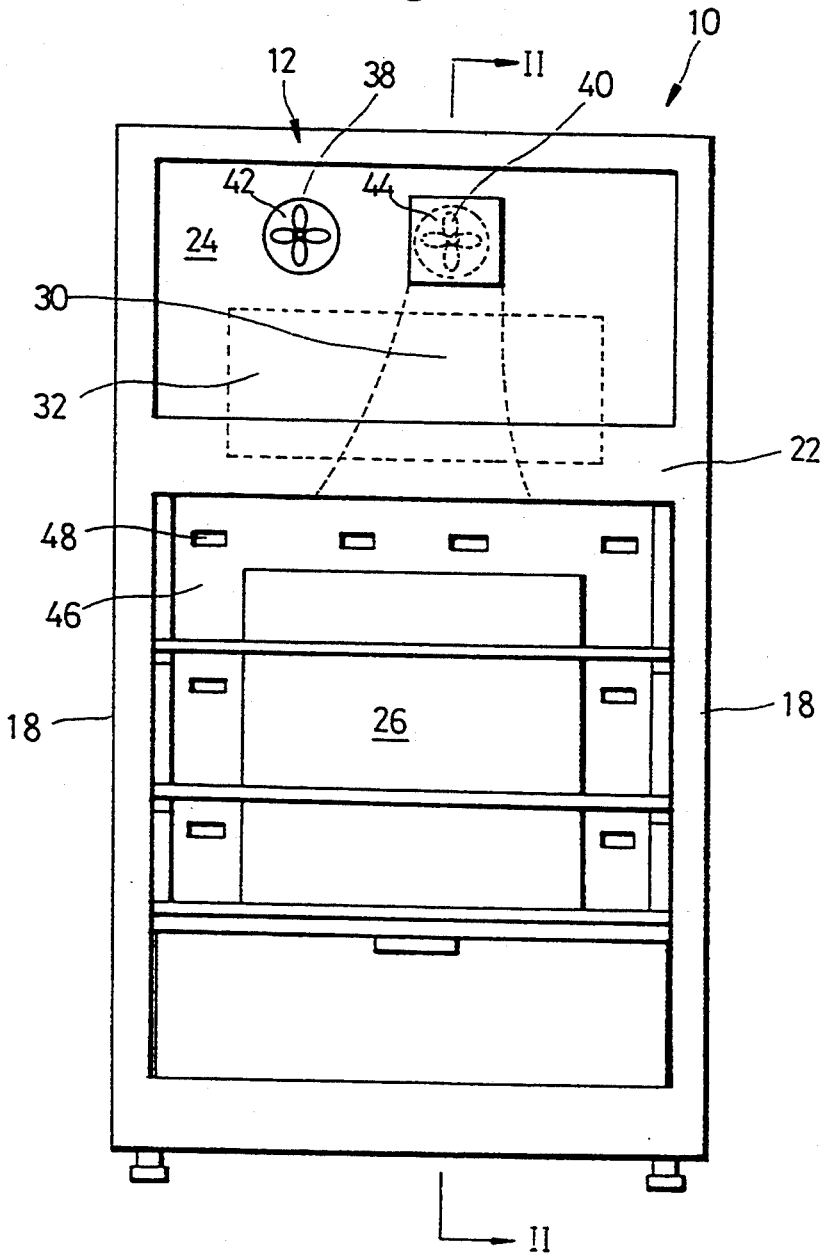
FIG. 1 is a front view of an air-circulated refrigerator in accordance with the present invention.
Figure 2:
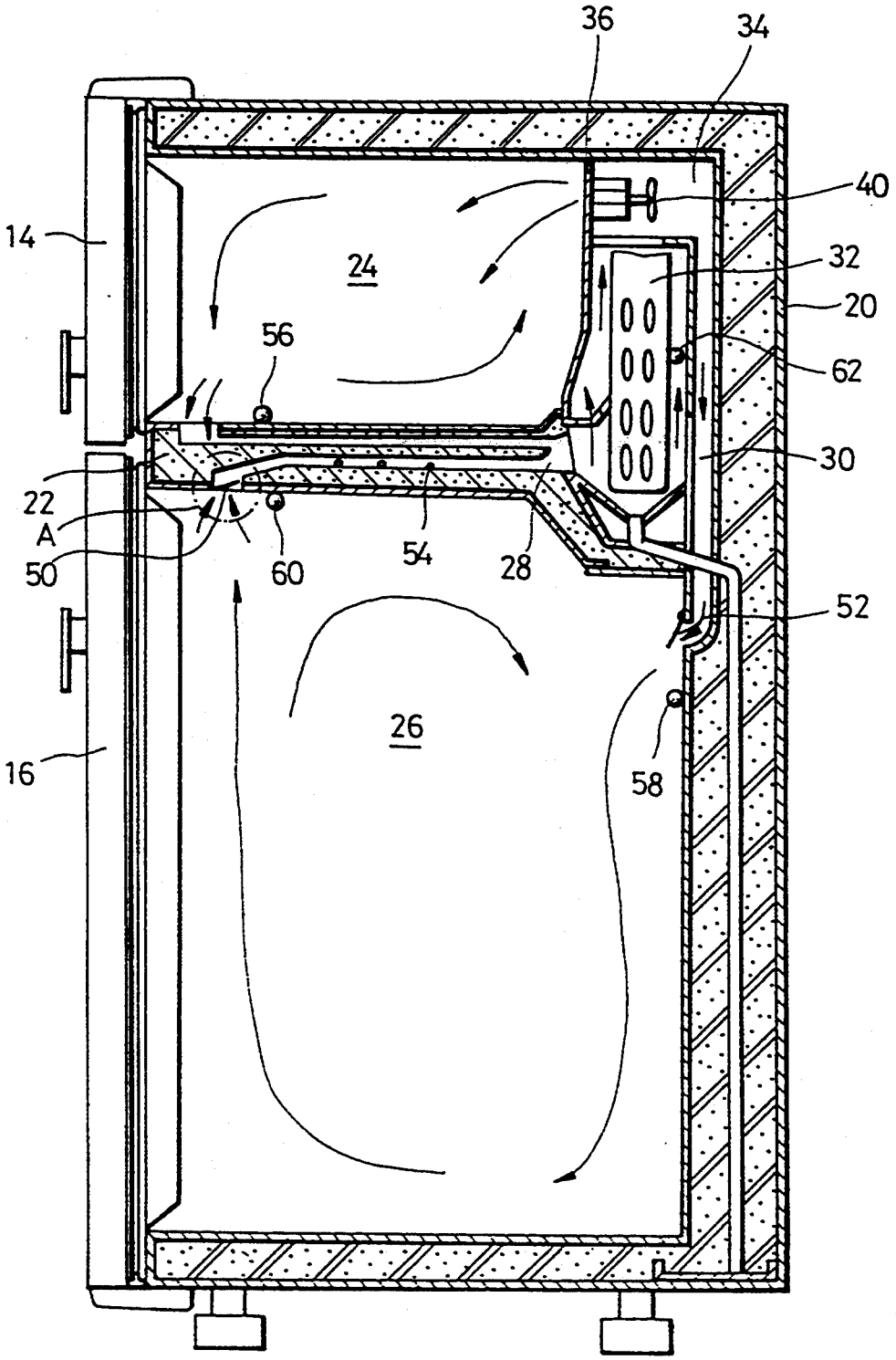
FIG. 2 is a cross-sectional view taken along line II—II in FIG. 1.

Referring first to FIG. 1, there is shown a front view of an air-circulated refrigerator in accordance with the present invention with a first and a second front doors removed. As shown, the refrigerator 10 includes a housing 12 having a first and a second front doors 14, 16(see FIG. 2), a pair of sidewalls 18, a rear wall 20(see FIG. 2), and a partition 22. A freezer compartment 24 is defined above the partition 22 and a fresh food compartment 26 is situated below the partition 22. The freezer compartment 24 is air communicated with the fresh food compartment 26 through a first passageway 28(see FIG. 2) formed in the partition 22 and a second passageway 30 formed in the rear wall 20, An evaporator 32(shown in phantom lines) for evaporating a refrigerant is situated in an evaporator chamber 34 defined between the rear wall 20 and a barrier 36, as shown in FIG. 2. A first fan 38 is mounted on the rear wall and a second fan 40 is mounted on the barrier 36. The barrier 36 has an opening 42 for permitting a stream of cold air blown by the first fan 38 to enter into the freezer compartment 24. The second passageway 30 has an inlet 44 for permitting a stream of cold air blown by the second fan 40 to enter into the fresh food compartment 26. The air blown into the inlet 44 is transferred to the fresh food compartment 26 through the second passageway 30 formed in the rear wall 20. The second passageway 30 is bifurcated at the threshold of the fresh food compartment 26 to form a branched-off duct 46 having a number of discharging ports 48 for supplying the cold air into the fresh food compartment 26.

FIG. 2 illustrates a cross-sectional view taken along line II—II in FIG. 1. As shown, the first passageway 28 formed in the partition 22 has a first flexible flap 50(see FIG. 3) for permitting an air flow to move from the fresh food compartment 26 to the evaporator 32 and preventing the air in the freezer compartment 24 from flowing into the fresh food compartment 26 when the second fan 40 is stopped. The first passageway 28 has two portions, i.e., an upper portion wherein the cold air is moved from the freezer compartment 24 to the evaporator 32, and a lower portion wherein the air warmed in the fresh food compartment 26 is moved to the evaporator 32, thereby allowing the recirculation of air in the refrigerator. The discharging ports 48 in the second passageway 30 preferably have a number of second flexible flaps 52 for permitting an air flow to move from the evaporator 32 to the fresh food compartment 26 and preventing it from moving backward. Located in the lower portion of the first passageway 28 is a number of heaters 54 for removing the frost formed on the evaporator 32, in response to a signal from a frost detecting sensor located on the evaporator 32. A first thermo-sensitive device 56 is located in the freezer compartment 24 to detect the temperature therein. A second thermo-sensitive device 58 is located in the fresh food compartment 26 in the vicinity of the second passageway 30 to detect the temperature of the air newly supplied into the fresh food compartment 26, and a third thermo-sensitive device 60 is located in the fresh food compartment 26 in the vicinity of the first passageway 28 to detect the temperature of the air which has been circulated in the fresh food compartment 26. Therefore, it may be preferable that the reference or threshold temperature for each of the second and the third thermo-sensitive devices 58, 60 has a different value; i.e., the reference temperature for the second thermo-sensitive device 58 is lower than that of the third thermo-sensitive device 60.

Figure 3:
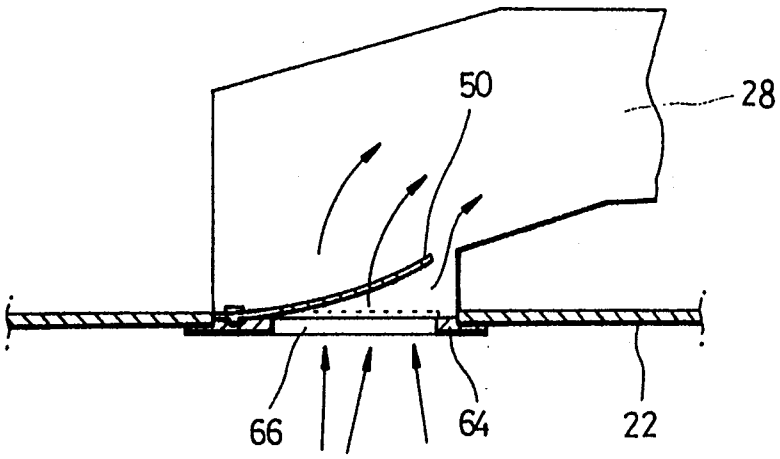
FIG. 3 is an enlarged cross-sectional view of portion A in FIG. 2.

Referring to FIG. 3, there is shown an enlarged cross-sectional view of the proximate area A of the first flexible flap 50 shown in FIG. 2. As illustrated, the first flexible flap 50 is fixed on a bracket 64 at one of its ends. The bracket 64 has a hole 66 smaller than the flexible flap 50 and is attached to the partition 22 at a lower end of the first passageway 28. Therefore, the air which has been circulated in the fresh food compartment 26 tends to urge the flexible flap 50 upward to permit the air to move toward the evaporator 32 when the second fan 40 is operated. On the other hand, when the second fan 40 is stopped, the first flexible flap 50 is lowered by its own weight to prevent the air in the freezer compartment 24 from flowing backward to the fresh food compartment 26.

Hereinafter, it will be described how the fans, the evaporator and the heaters are operated by a thermostatic control circuitry in response to the signals from the thermo-sensitive devices and the frost detecting sensor, with reference to the truth table provided herein and the accompanying drawings.

Figure 4:
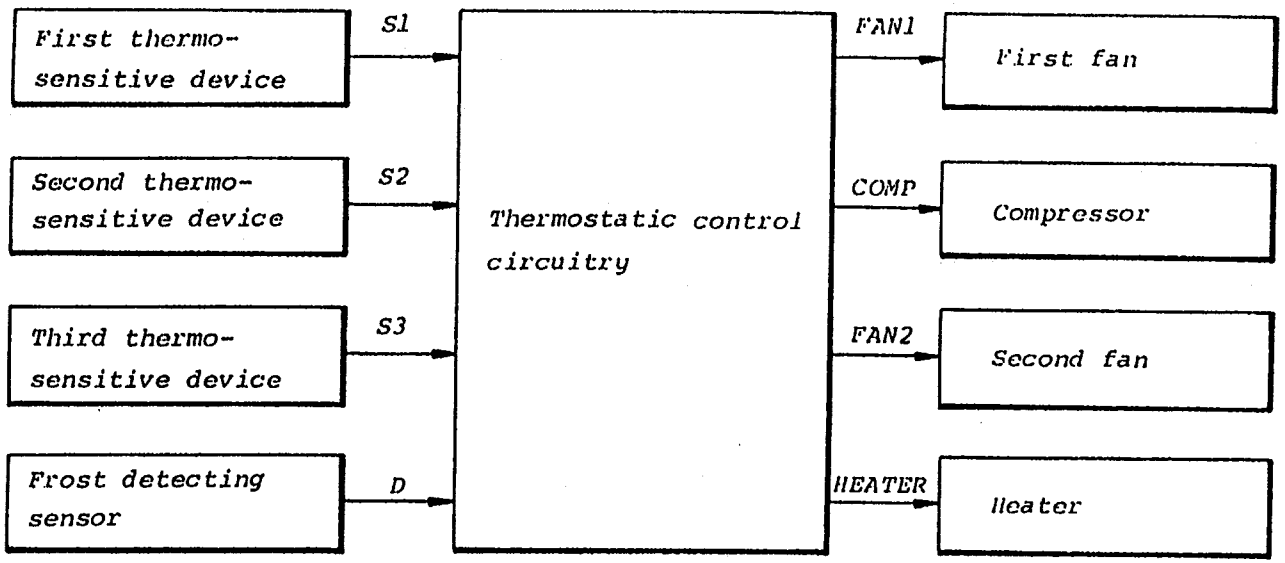
FIG. 4 is a schematic block diagram of a thermostatic control circuitry in accordance with the present invention; and, FIG. 5 is a detailed circuit diagram of a thermostatic control circuitry in accordance with the present invention.

Turning now to FIG. 4, there is shown a thermostatic control circuitry in accordance with the present invention. The three thermo-sensitive devices and the frost detecting sensor shown in FIG. 2 are electrically connected to the thermostatic control circuitry to send their sensor signals thereto. The thermostatic control circuitry operates the first and the second fans, the heater(s) and the compressor in response to the respective signals sent from the devices and the sensor to control the temperature of the freezer and the fresh food compartments.

To effectively control the fans, the compressor and the heater, all possible combinations of the signals from the devices and the sensor were investigated. The results are presented in the truth table given below.

TRUTH TABLE

| S1 | S2 | S3 | D | FAN1 | COMP | FAN2 | HEATER |
|---|---|---|---|---|---|---|---|
| H | H | H | H | L | L | H | H |
| H | H | H | L | L | L | L | L |
| H | H | L | H | L | L | H | L |
| H | H | L | L | L | L | H | L |
| H | L | H | H | L | L | H | H |
| H | L | H | L | L | L | H | L |
| H | L | L | H | L | L | H | L |
| H | L | L | L | L | H | H | L |
| L | H | H | H | H | H | H | L |
| L | H | H | L | H | H | L | L |
| L | H | L | H | H | H | H | L |
| L | H | L | L | H | H | H | L |
| L | L | H | H | H | H | H | L |
| L | L | H | L | H | H | H | L |
| L | L | L | H | H | H | H | L |
| L | L | L | L | H | H | H | L |

In the above truth table, 'S1' denotes a signal from the first thermo-sensitive device in the freezer compartment, 'S2' represents a signal from the second thermo-sensitive device in the fresh food compartment in the vicinity of the second passageway, 'S3' indicates a signal from the third thermo-sensitive device in the fresh food compartment in the vicinity of the first passageway, and 'D' stands :for a signal from the frost detecting sensor. Each of the signals S1, S2, S3 and D has a logic high 'H' and a logic low 'L'. The logic low 'L' for the signals S1, S2 and S3 is produced when each of their sensed temperatures exceeds each of their predetermined threshold or reference temperatures. And the logic high 'H' for the signal D is generated when the depth of the frost layer formed on the evaporator exceeds a predetermind frost thickness. On the other hand, each of the signals 'FAN1', 'COMP', 'FAN2' and 'HEATER' represents the respective control signal to the first fan, the compressor, the second fan and the heater. Each control signal has a logic high 'H' and a logic low 'L'. The control signals 'H' and 'L' denote the operation start and operation stop signals for the first fan, the compressor, the second fan and the heater.

By using the rules of Boolean algebra, each of the control signals 'FAN1', 'COMP', 'FAN2' and 'HEATER' according to the above trugh table can be represented by the following equations:

$$FAN1=\overline{S1}$$

$$COMP=\overline{S1(S2+S3)}$$

$$FAN2=\overline{S2S3}+D$$

$$HEATER=S1S3D(S2+S3)$$

Figure 5:
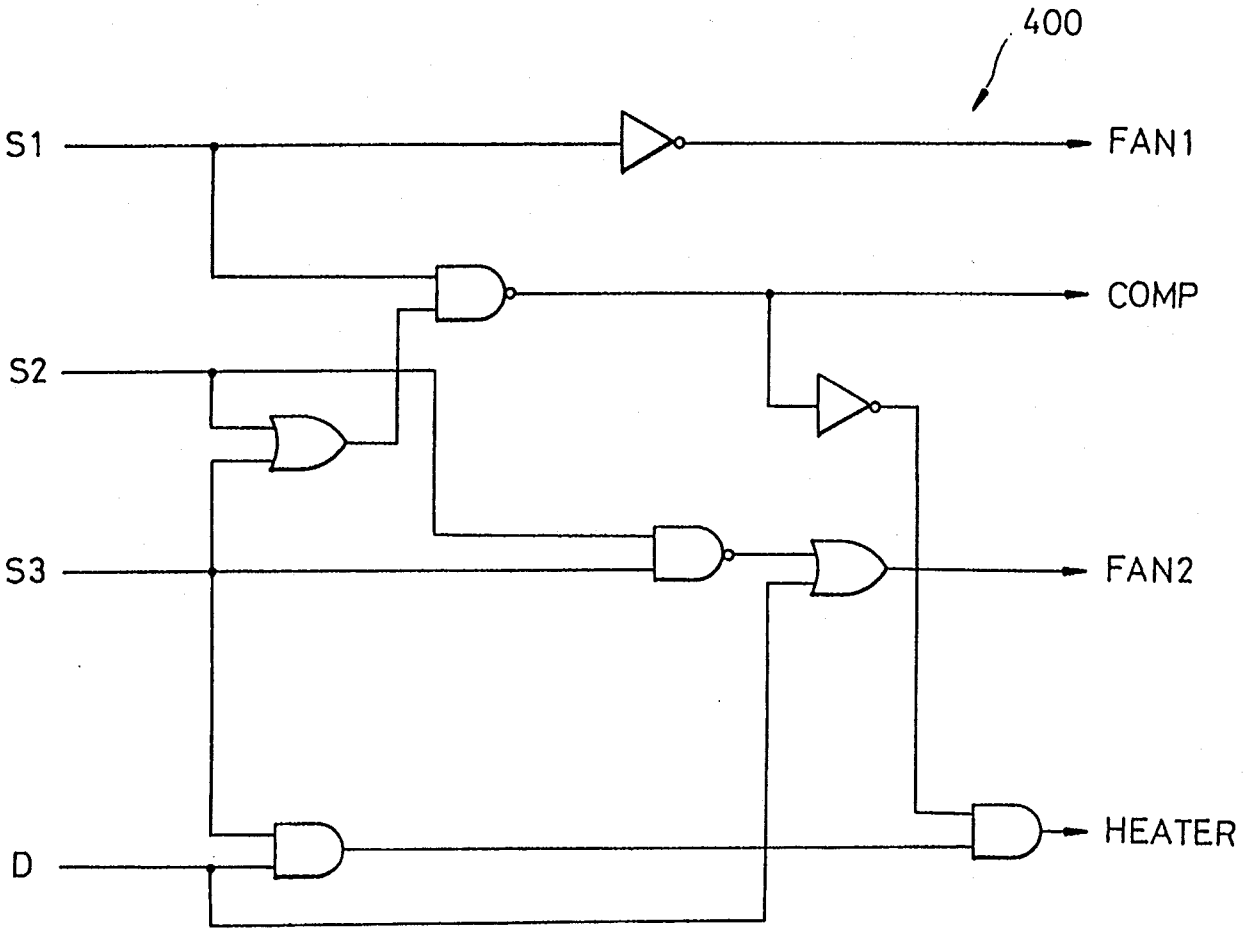

Each output signal in accordance with the above equations can be contructed as shown in FIG. 5. As shown, when the temperature in the freezer compartment is risen above its threshold temperature(S1='L'), the first fan and the compressor are operated(FAN1, COMP='H'). Also, when any of the second and the third thermo-sensitive devices detects their temperature being above their respective threshold value(S2='L', or S3='L'), the second fan or the compressor is operated(FAN2 or COMP='H'). Further, when the frost detecting sensor detects frost formed on the evaporator in excess of a predetermined thickness (D='H'), the second fan is operated (FAN2='H') to blow the circulated air from the fresh food compartment to the evaporator, thereby accomplishing a first defrosting mode. If some of the frost still remains unremoved in excess of the threshold thickness, the defrosting heaters are driven to raise the temperature of the air passing through the first passageway so as to operate in a second defrosting mode.

Although the invention has been shown and described with repsect to the exemplary embodiments, it should be understood by those skilled in the art that various changes, modifications and additions may be made, without departing from the spirit and scope of the invention.

What is claimed is:

1. An air-circulated refrigerator, incorporating therein a temperature regulating device, which includes a housing having first and second front doors, a pair of sidewalls, a rear wall, and a partition, a freezer compartment defined above the partition, a fresh food compartment defined below the partition and fluid communicating, by means of air, with the freezer compartment through a first passageway formed in the partition and a second passageway formed in the rear wall, said temperature regulating device comprising:

an evaporator situated between a barrier and the rear wall of the freezer compartment for cooling air by way of evaporating a refrigerant compressed by a compressor;

a first fan situated between the evaporator and the rear wall of the freezer compartment for directly supplying a flow of the air cooled by the evaporator through a hole formed in the barrier into the freezer compartment when the temperature of the freezer compartment drops under a first reference temperature;

a second fan mounted on the barrier and situated between the barrier and the evaporator for supplying another flow of the cooled air into the fresh food compartment through the second passageway when the temperature of the fresh food compartment drops under a second reference temperature;

a first flexible flap fixed to the first passageway at one of its ends for permitting the air in the fresh food compartment to move to the evaporator therethrough and preventing the air in the freezer compartment from flowing into the fresh food compartment; and at least one heater installed in the first passage way, wherein said second fan is driven without the heater being powered to accomplish a first defrosting mode for the purpose of removing frost formed on the evaporator in excess of a threshold thickness, and said heater is operated to accomplish a second defrosting mode when the frost formed on the evaporator still remains in excess of the threshold thickness even after the completion of the first defrosting mode.

2. The air-circulated refrigerator as recited in claim 1, wherein said temperature regulating device further comprises a first thermo-sensitive device located in the freezer compartment, a second thermo-sensitive device located in the fresh food compartment in the vicinity of the second passageway, and a third thermo-sensitive device located in the fresh food compartment in the vicinity of the first passageway.

3. The air-circulated refrigerator as recited in claim 1, wherein said temperature regulating device further comprises a second flexible flap fixed to the second passageway at one of its ends for permitting said another flow of the cooled air to move from the evaporator to the fresh food compartment therethrough and preventing it from flowing backward.

4. An air-circulated refrigerator, incorporating therein a temperature regulating device, which includes a housing having first and second front doors, a pair of sidewalls, a rear wall, and a partition, a freezer compartment defined above the partition, a fresh food compartment defined below the partition and communicating, by means of air, with the freezer compartment through a first passageway formed in the partition and a second passageway formed in the rear wall, said temperature regulating device comprising:

an evaporator situated between a barrier and the rear wall of the freezer compartment for cooling air by way of evaporating a refrigerant compressed by a compressor;

a first fan situated between the evaporator and the rear wall of the freezer compartment for directly supplying a flow of the air cooled by the evaporator through a hole formed in the barrier into the freezer compartment when the temperature of the freezer compartment drops under a first threshold temperature;

a second fan mounted on the barrier and situated between the barrier and the evaporator for supplying another flow of the cooled air into the fresh food compartment through the second passageway when the temperature of the fresh food compartment drops under a second threshold temperature;

a first flexible flap fixed to the first passageway at one of its ends for permitting the air in the fresh food compartment to move to the evaporator therethrough and preventing the air in the freezer compartment from flowing into the fresh food compartment;

at least one heater located in the first passageway for removing frost formed on the evaporator;

a first thermo-sensitive device located in the freezer compartment;

a second thermo-sensitive device located in the fresh food compartment in the vicinity of the second passageway;

a third thermo-sensitive device located in the fresh food compartment in the vicinity of the first passageway;

a frost detecting sensor located on the evaporator; and means for controlling the operation of the first and the second fans, the heater and the compressor, wherein said second fan is driven without the heater being powered in response to a first mode signal from the frost detecting sensor to accomplish a first defrosting mode for the purpose of removing frost formed on the evaporator in excess of a threshold thickness, and said heater is operated in response to a second mode signal from the frost detecting sensor when the layer of frost formed on the evaporator still remains in excess of the threshold thickness even after the completion of the first defrosting mode.

5. The air-circulated refrigerator as recited in claim 4, wherein said first fan and said compressor are operated in response to a command signal from the first thermo-sensitive device when the temperature in the freezer compartment reaches a threshold temperature, and said second fan and said compressor are operated in response to a second or a third command signal from either the second or the third thermo-sensitive device when the temperature in the fresh food compartment reaches a second or a third threshold temperature.

* * * * *